US005765926A

United States Patent [19]

Knapp

[11] Patent Number: 5,765,926

[45] Date of Patent: Jun. 16, 1998

[54] APPARATUS FOR ROUTERING A SURFACE AND A CUTTING HEAD AND TOOL PIECE THEREFOR

[76] Inventor: Roger O. Knapp, 155 Suffolk St., West, Guelph, Ontario, Canada, N1H 2J7

[21] Appl. No.: 642,789

[22] Filed: May 3, 1996

[51] Int. Cl.[6] ..... E01C 23/09; E01C 23/088

[52] U.S. Cl. ..... 299/39.3; 299/39.6; 299/41.1

[58] Field of Search ..... 299/39.3, 39.6, 299/41.1; 175/434; 404/90

[56] References Cited

U.S. PATENT DOCUMENTS

| | | | |
|---|---|---|---|
| 3,318,400 | 5/1967 | Hildebrandt | 175/434 |
| 4,175,788 | 11/1979 | Jacobson et al. | 299/1.5 |
| 4,204,714 | 5/1980 | Jacobson et al. | 299/1.5 |
| 4,848,845 | 7/1989 | Kennedy | 299/39.3 |
| 4,968,101 | 11/1990 | Bossow | 299/411.1 |
| 5,116,162 | 5/1992 | Burhite | 299/41.1 |

FOREIGN PATENT DOCUMENTS

| | | | |
|---|---|---|---|
| 1126074 | 6/1982 | Canada . | |
| 3837819 | 5/1990 | Germany | 404/90 |

*Primary Examiner*—David J. Bagnell

*Attorney, Agent, or Firm*—Renner, Otto, Boisselle & Sklar

[57] ABSTRACT

Apparatus for routering a surface comprises a pair of independently driven drive wheels and a balance wheel which is freely pivotal to follow a path steered by the drive wheels. A cutting head is pivotally mounted between the drive wheels and its height relative to the surface may be adjusted to alter the depth of the router action. An operator's seat is located such that the operator has a relatively unobstucted view of the surface to be routed and the cutting head. A control for adjusting the height of the cutting head is provided adjacent the operator's seat, as are controls for the drive wheels. An improved cutting head assembly and cutting tool place are also disclosed, the cutting head assembly including a rotating shaft with a cutting head at one end, the shaft being orientated perpendicularly to the surface to be routered. The cutting head retains a diamond tipped cutting tool piece which rotates with the shaft to router the surface.

12 Claims, 2 Drawing Sheets

APPARATUS FOR ROUTERING A SURFACE AND A CUTTING HEAD AND TOOL PIECE THEREFOR

FIELD OF THE INVENTION

The present invention relates to an apparatus for routering a surface and a cutting head and tool piece therefore. More specifically, the present invention relates to an apparatus for routering surfaces such as concrete and asphalt with reasonable accuracy of positioning and depth and an improved cutting head and tool piece therefore.

BACKGROUND OF THE INVENTION

Apparatus for routering surface art well known and include systems for routering cracks in asphalt or concrete as a step in the process of repairing those cracks. Such system may also be used to remove paint from the asphalt or concrete surfaces, by setting the routering action to a depth substantially equivalent to the paint thickness, and for a variety of other purposes.

As used herein, the terms cut and/or router a surface and cut or router a groove in a surface are intended to comprise the removal of undesired material from a surface. Such undesired material can be a portion of the material making up the surface, such as the cutting of a groove in an asphalt surface to repair a crack therein, or the removal of material which has been previously applied to a surface, such as removing paint from a concrete surface substantially without damaging the surface.

Prior art routers include those described in U.S. Pat. No. 4,175,788 and 4,204,714 to Crafco Inc. Generally, these routers comprise a two wheeled device with a cutting head located between the wheels and motor mounted above the wheels. The cutting head includes a horizontal shaft, which is substantially in line with the axis of the wheels, and a pair of large diameter steel discs spaced about five inches apart the center of the shaft Six cutting blades are mounted between these discs via six pins which extend between the discs and through the center of the respective blade. Each of these cutting blades includes eight cutting blades which extend radically from the center of the blades in a star-like manner.

The shaft and the assembly of the discs and blades is rotated by the motor, via a belt drive, and the blades are free to rotate on the pins and also have some free play between their centers and the pins. As the discs are rotated by the motor, the cutting blades pound a cut into the surface being worked.

A set of handles extend from the device and are held by the operator working the device who uses the handles to propel the device and to steer the cutting head onto the crack or other surface area to be routered. An electric switch is provided on the handles to operate a motorized screw actuator which is used to alter the routering depth of the cutting head by moving the cutting head vertically, relative to the two wheels and the surface.

Problem exist with the prior art router devices in that it is difficult for the operator to accurately control the positioning of the cutting head. It is also difficult, if not impossible, for the operator to control the routering depth of the device in that the actuator is not susceptible to accurate operation and the inevitable vertical movement of the handles by the operator while controlling the device also results in changes to the routering depth. Further, as the operator must exert great care when maneuvering and propelling the device with the handles, the amount of surface which is routed in a given time is reduced from that which would be routed if accurate operation and movement of the devices was easier. Also, and perhaps most importantly, with conventional cutting heads such as those disclosed in the above-mentioned U.S. patents to Crafco, due to the pounding action whereby the cutting blade effects its cut, micro cracks may be formed in the surface being worked adjacent the cut, resulting in new damage be introduced to the surface.

SUMMARY OF THE INVENTION

It is an object of the present invention to provide a novel apparatus for routering a surface which obviates or mitigates at least one of the above-described disadvantages of the prior art. It is a further object to provide a novel cutting head and tool piece therefore for routering a surface.

According to a first aspect of the present invention, there is provided a self propelled device for cutting groove in a surface, comprising:

a frame;

prime mover means;

at least on pair of drive wheels rotatably mounted to said frame and each wheel independently driven by said prime mover means and rotating about a substantially common axis;

at least one balance wheel rotatably mounted to said frame and operable with said at least one pair of drive wheels to support said device on said surface, said balance wheel being substantially freely pivotable about a vertical axis to allow said device to be steered by said driven wheels;

a cutting head assembly vertically moveable between a desired working position wherein at least one cutting tool piece in said cutting head assembly contacts said surface and a free position wherein said at least one cutting tool piece is above said surface, said cutting head assembly being driven by said prime mover to cut said surface with said cutting tool piece;

a steering means to operate each of said drive wheels to move and steer said device; an a cutting bead control means to move said cutting head assembly between said desired working position and said free position.

According to yet another aspect of the present invention, there is provided a cutting head assembly for routering a surface, comprising:

a tool collar;

a shaft rotatably mounted to said collar;

means to rotate said shaft;

a cutting head mounted to one end of said shaft and rotating therewith, said head being operable to receive at least one cutting tool piece:

a pivotal mount to connect said tool collar to a cutting device and to allow the height of the tool piece relative to a surface to be altered.

According to yet another apect of the present invention, there is provided a tool piece for routering a surface, comprising;

a cylindrical steel body;

a filler material comprising a mixture of micron-sized tungsten carbide particles and a diamond setting binder, said mixture forming a plurality of finger depending from said steel body and forming a layer over at least a portio of said steel body;

a plurality of industrial bonded to outer and lower faces of said fingers to form a cutting surface thereon; and a carrier attached to said steel body, said carrier include means to attach said tool piece to a cutting head.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
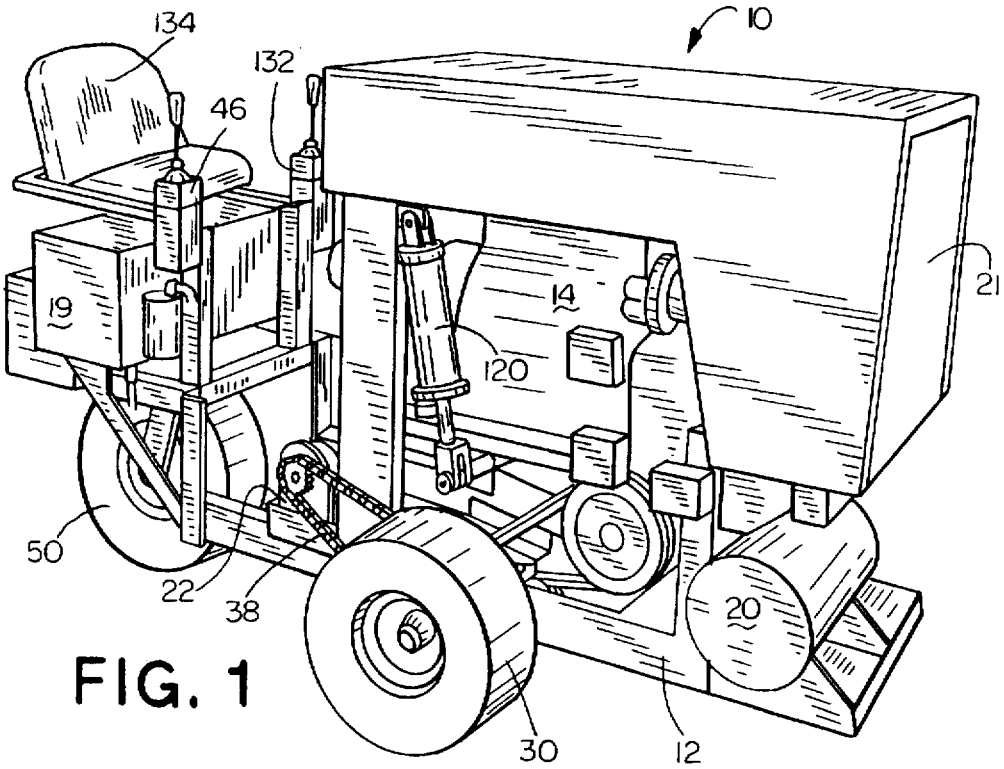
FIG. 1 shows a perspective new of a router in accordance with an embodiment of the present invention.
Figure 2:
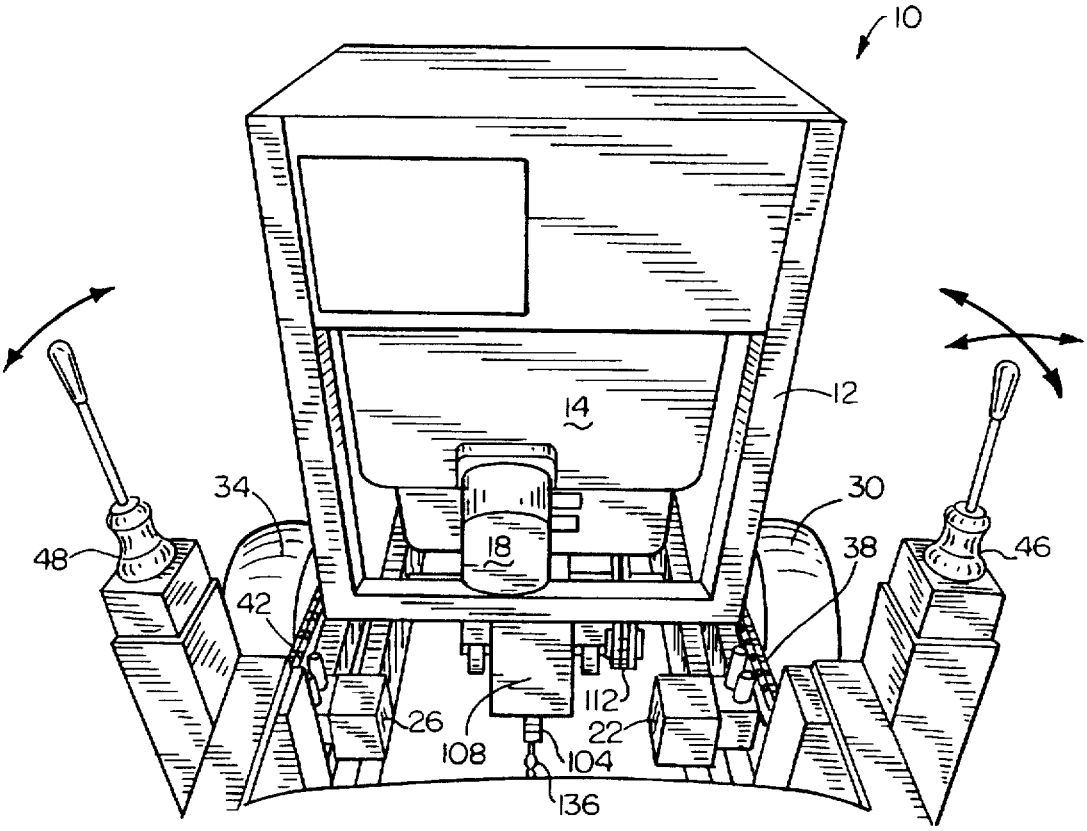
FIG. 2 shows a view of the router of FIG. 1 from the operator's chair.

A router device in accordance with an embodiment of the present invention is indicated generally at 10 in FIGS. 1 and 2. Device 10 includes a frame 12, a prime mover means 14, which in this embodiment is a forty-seven HP diesel engine, operatively coupled to a hydraulic pump 18 which is in turn coupled to a variety of devices, described below. A diesel fuel tank 20 is provided at one end of device 10, as is a radiator 21 and a supply of hydraulic oil for pump 18 is maintained in tank 19.

Device 10 is propelled by a pair of hydraulic motors 22 and 26, mounted to frame 12, each of which rotates a respective one of a pair of drive wheels 30 and 34 via chain drives 38 and 42. Drive wheels 30 and 34 are mounted to frame 12 via axles and suitable bearings, not shown. Motors 22 and 26 are controlled by joysticks 46 and 48, respectively, which operate an appropriate set of valves to supply hydraulic pressure from pump 18 to motors 22 and 26 such that pushing joysticks 46 and 48 forward moves device 10 forward, pulling joysticks 46 and 48 backward moves device 10 backward and moving one of joysticks 46 and 48 forward and the other backward causes device 10 to rotate either clockwise or counter-clockwise, depending upon the relative joystick positions, about a point midway between the axles of drive wheels 30 and 34.

A balance wheel 50 is to frame 12 adjacent one end of device 10 and acts' as a third support point, in addition to drive wheels 30 and 34, for device 10. In this embodiment of the present invention, the center of gravity of device 10 is located between the of the axles of drive wheels 30 and 34 and balance wheel 50 and thus device 10 is stable on these three contact points. Balance wheel 50 is mounted to frame 12 such that it may freely turn about a vertical axis and thus, as drive wheels 30 and 34 are driven by motors 22 and 26 to steer a desired path for device 10, balance wheel 50 is free to turn to allow device 10 to follow that path. It is contemplated that an additional balance wheel (not shown) may be provided at the end of device 10 opposite balance wheel 50 to stabilize the device when the center of gravity is not otherwise favorably located. If this additional balance wheel is provided, it can be similarly mounted to frame 12 to operate to allow device 10 to be steered by drive wheels 30 and 34.

While hydraulic motors 22 and 26 and chain drives 38 and 42 are employed in this embodiment of the present invention, it is contemplated that a hydrostatic drive may be preferred in some circumstances and the selection, use and configuration of such a drive will be readily apparent to those of skill in the art.

Figure 3:
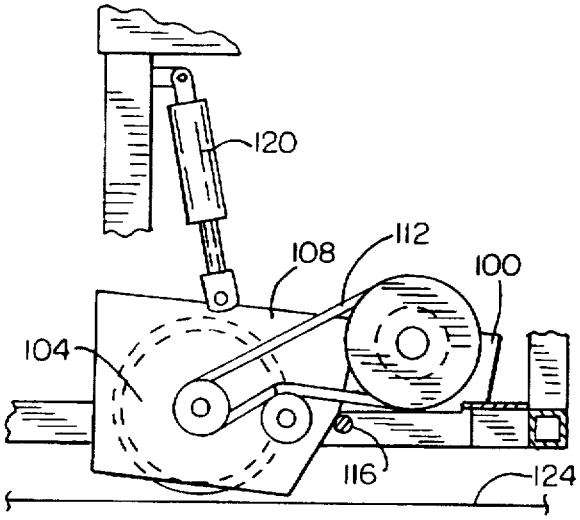
FIG. 3 shows a partial cut away view of a cutting head assembly of the router of FIG. 1 in a raised position.
Figure 4:
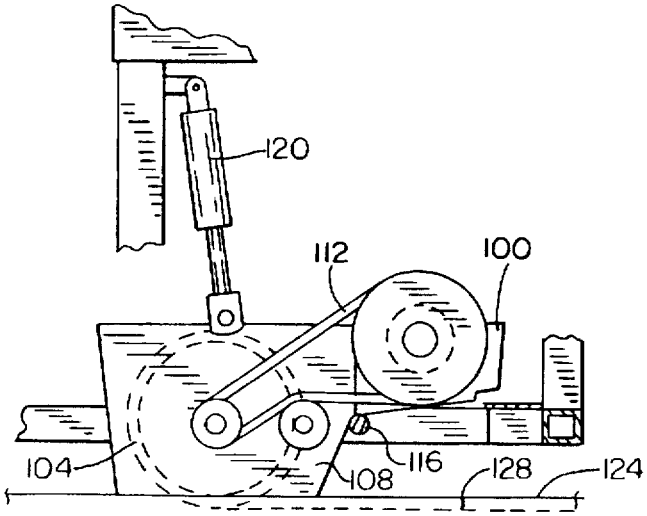
FIG. 4 shows the cutting head assembly of FIG. 3 is a lowered position.

In addition to suppling hydraulic pressure to motors 22 and 26, pump 18 also supplies hydraulic pressure to cutting head motor 100. Specifically, as best shown in FIGS. 3 and 4, a cutting head assembly 108 includes cutting head motor 100 and a cutting head 104 which is rotatably mounted to cutting head assembly 108. Cutting head motor 100 drives cutting head 104 via a dual belt drive 112 as shown. Cutting head 104 is similar to the conventional cutting heads, as described above, with a pair of spaced discs with a plurality of cutting tools (not shown) mounted therebetween.

Cutting head assembly 108 is mold pivotal to the frame of device 10 via a pivot pin 116 and a hydraulic ram 120 extends between a vertical member of frame 12 and cutting head assembly 108 such that the working portion of cutting wheel 104 is lowered or raised as ram 120 is extended or retracted. In the raised position, shown in FIG. 3, cutting wheel 104 is disengaged from surface 124 allowing device 10 to be moved to a desired position. In the lowered position, shown in FIG. 4, cutting wheel 104 engages surface 124 and a groove 128 can be routered to a selected depth. As will be apparent, cutting head assembly 108 is located within a perimeter defined by balance wheel 50 and drive wheels 30 and 34.

Ram 120 is controlled by moving joystick 46 from side to side which, via appropriate valving, provides for accurate control of the position (depth) of cutting wheel 104 relative to surface 124. It is contemplated that, if required, joystick 46 and its associated valving may provide for changes to cutting wheel 104 to an accuracy of about 1 mm.

FIG. 2 shows the view an operator has when seated in the operator's chair 134. As will be noted, the operator has a clear view of the area which is to be worked, in this example a crack 136 in an asphalt surface, as well as cutting wheel 104 and cutting head assembly 108 in general. It is contemplated that, the combination of the accuracy of movement provided by drive wheels 30 and 34 via joysticks 46 and 48 and he relatively clear view of the working area provided will result in an operator being able to router surface 124 more quickly than with prior art devices and with greater accuracy, both in terms of positioning of groove 128 and of its depth.

Figure 5:
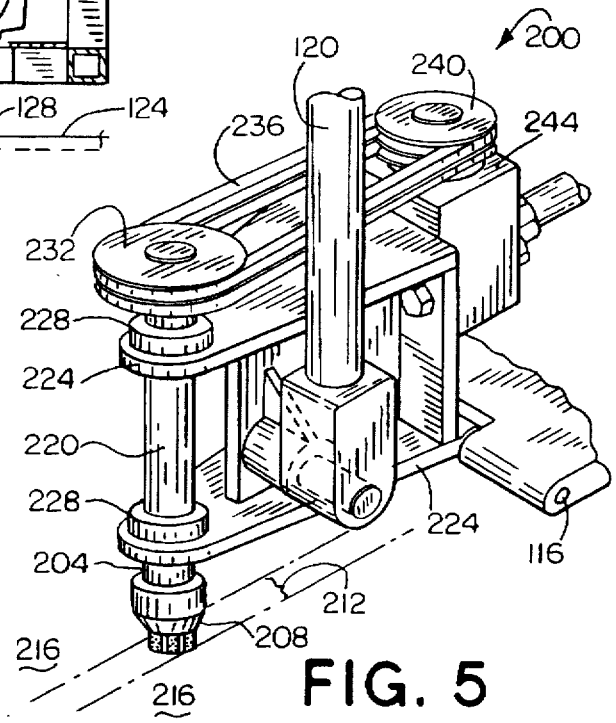
FIG. 5 shows another embodiment of a cutting head assembly.

In FIG. 5 another cutting head assembly for use with device 10 is indicated generally at 200. In this embodiment, cutting head assembly 200 includes a shaft 220 which is rotatably mounted in a tool collar 224 via a pair of bearings 228. Shaft 220 includes a cutting head 204 at one end and a drive pulley 232 is fixed to the other end of shaft 220. Drive pulley 232 receives a double belt drive 236 from a drive pulley 240 rotated by a hydraulic motor 244 which is also mounted to tool collar 224. Hydraulic motor 244 is operated by hydraulic pressure supplied from pump 18, as in the embodiment of FIGS. 1 through 4 discussed above. Cutting head 204 includes a male threaded portion (not shown) to receive tool piece 208, described below.

Figure 6:
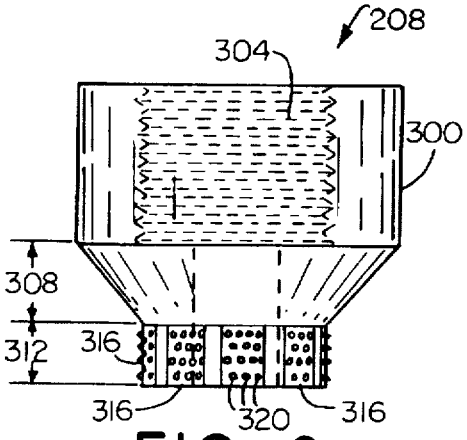
FIG. 6 shows a side view of a tool piece for use with the cutting head assembly of FIG. 5.
Figure 7:
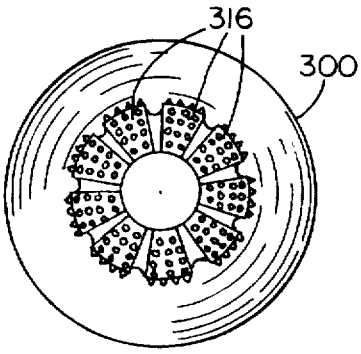
FIG. 7 shows a bottom view of the tool piece of FIG. 6.

Tool piece 208, which is best seen in FIGS. 6 and 7, includes a body 300 which in the presently preferred embodiment is formed of hardened steel. Carrier body 300 includes a female threaded portion 304 to engage the complementary threaded portion of cutting head 204 and tapers through a transition zone 308 to cutting portion 312. Cutting portion 312 includes nine depending fingers 316 which are arranged in a circular pattern. Fingers 316 include tungsten carbide outer and bottom surfaces to which several industrial diamonds 320 have been mounted as shown in the FIGS. Diamonds 320 are mounted to fingers 316 through any suitable process, such as by silver soldering into recesses formed in fingers 316, as will occur to those of skill in the art. In the presently preferred configurations of tool piece 208, the height of fingers 316, and thus cutting portion 312, can be 20 mm or 40 mm depending upon the maximum desired depth of the grove to be routered with tool piece 208. The diameter of cutting portion 312 is presently preferably about 40 mm, other diameters or heights can be constructed as desired and larger diameter tool pieces 208 may favorably include more than nine fingers 316 while smaller diameter tool pieces 208 may include less than nine fingers 316.

The presently employed method of fabricating tool piece 208 is to insert a steel body into an appropriately shaped mold along with filler material of micron-size tungsten carbide mixed with a diamond sewing binder to promote eventual bonding of diamonds 320. The slots between fingers 316 are formed by inserting graphite spacers in the filler material and the mold is then inserted into a furnace for firing. After being appropriately fired, the graphite spacers are removed and diamonds 320 are bonded to fingers 316 by silver soldering. Carrier body 300 is then attached, after having been appropriately threaded. While this fabrication method is presently employed, it is believed that other suitable methods will occur to those of skill in the art.

As was the case with cutting had assembly 108, cutting head assembly 200 is pivotally mounted to device 10 via a pivot pin 116 and hydraulic ram 120 connects to tool collar 224 as shown in FIG. 5 such that cutting head 204 may be raised or lowered in to and out of engagement with surface 216.

In operation, cutting head 204, and thus tool piece 208, is rotated at an appropriate speed by hydraulic motor 244 and ram 120 lowers cutting head 204 until cutting portion 312 of tool piece 208 engages the surface 216 to be routered to the desired depth of a groove 212. An adjustable foot plate (not shown) attached to tool collar 224 extends toward surface 216 to ensure that cutting head 204 is not lowered too far, to prevent portions of tool piece 208 other than cutting portion 312 from contacting surface 216. Ram 120 maintains tool piece 208 at the desired work depth, as set with joystick 46, and provides sufficient downward pressure to keep the lower surfaces of fingers 316 in cutting engagement with surface 216 as tool piece 208 is moved along surface 216 with device 10. Depending upon the diameter and configuration of tool piece 208 and de composition of surface 216, the rotational speed of shaft 220 can be set to speeds of from about 3000 RPM to about 12000 RPM.

It is contemplated that the diamond tipped tool piece 208 will provide cleaner and more accurate cuts than conventional knife-based cutting heads and will be less expensive to maintain than such prior art devices, requiring only normal replacement of tool pieces 208. Further, it is contemplated that use of tool piece 208 will avoid the formation of micro crack damage to the working surface. It is also contemplated that replacement of tool pieces 208 can be accomplished in a relatively simple and quick manner compared to the replacement of the cutting tools in conventional cutting heads such as cutting head 104 describe above. Specifically, a spent tool piece 208 can simply be, unscrewed from cutting head 204 and a new tool piece 208 screwed on. It is further contemplated that spent tool piece 208 may be refurbished, with diamonds 320 being replaced as necessary and tungsten carbide surface being repaired as necessary.

While the embodiment of cutting head assembly 200 shown in FIG. 5 is presently preferred, one of the advantages of device 10 is that it may use either cutting head assembly interchangeably. Thus, device 10 can be sold with either or both of cutting head assembly 108 and cutting head assembly 200, or retro fitted with either as desired. It is further contemplated that cutting head assembly 200 can be modified, as will be apparent to those of skill in the art, to allow retrofitting to prior art routering devices if such should be desired.

It is further contemplated that device 10 may be equipped with a vacuum system (not sown) which is operable to capture the detritus and debris produced by the cutting operations. It is contemplated that such as vacuum system can be employed with either embodiment of cutting head assembly disclosed above, although it is presently believed that better capture results art obtain from cutting head assembly 200.

The above-described embodiment of the invention are intended to be examples of the present invention and alterations and modifications may be effected thereto, by those of skill in art, without departing from the scope of the invention which is defined solely by the claims appended hereto.

We claim:

1. A self propelled device for cutting a groove in a surface, comprising:

a frame;

an operator position:

prime mover means;

at least one pair of drive wheels rotatably mounted to said frame and each wheel independently driven by said prime mover means and rotating about a substantially common axis;

at least one balance wheel rotatably mounted to said frame and operable with said at least one pair of drive wheels to support said device on said surface, said balance wheel being substantially freely pivotable about a vertical axis to allow said device to be steered by said driven wheels;

a cutting head assembly located within a perimeter defined by said at least one pair of drive wheels and said at least one balance wheel such that said cutting head assembly is observable from said operator position and is vertically moveable between a desired working position wherein at least one cutting tool piece in said cutting head assembly contacts said surface and a free position wherein said at least one cutting tool piece is above said surface, said cutting head assembly being driven by said prime mover to cut said surface with said cutting tool piece;

a steering means operable from said operator position to operate each of said drive wheels to move and steer said device; and a cutting head control means operable from said operator position to move said cutting head assembly between said desired working position and said free position.

2. A device according to claim 1 wherein said steering means comprises a pair of joystick controls, each one of said pair of joystick controls controlling movement of as respective one of said driven wheels.

3. A device according to claim 2 wherein said cutting head control means comprises one of said pair of joystick controllers.

4. A device according to claim 1 wherein said cutting head control means operates a hydraulic ram to move said cutting head assembly between said desired working position and said free position.

5. A device according to claim 1 wherein said cutting head assembly is driven by a hydraulic motor by hydraulic pressure supplied from said prime mover.

6. A device according to claim 1 wherein said cutting head assembly comprises:

a tool collar pivotally connected to said frame;

a shaft rotatably mounted to said tool collar, said shaft including a cutting head at one end to receive at least one cutting tool piece; and means to rotate said shaft, where in said working position said shaft is substantially vertical and said cutting tool piece is in cutting engagement with said surface.

7. A device according to claim 6 wherein said cutting head assembly removably receives said at least one cutting tool piece.

8. A device according to claim 6 wherein said means to rotate said shaft comprises at least one pulley mounted to said shaft to receive a belt drive.

9. A device according to claim 6 wherein said at least one cutting tool piece includes a diamond tipped cutting portion.

10. A device according to claim 6 wherein said tool collar includes a mount for one end of a hydraulic ram, said hydraulic ram extending and retracting to alter the height of said cutting head relative to said surface.

11. A device according to claim 1 wherein each of said drive wheels is driven by a respective hydraulic motor.

12. A device according to claim 1 wherein each of said drive wheels is driven by a hydrostatic drive.

* * * * *